US006545396B1

(12) United States Patent
Ohki et al.

(10) Patent No.: US 6,545,396 B1
(45) Date of Patent: Apr. 8, 2003

(54) IMAGE FORMING DEVICE USING FIELD EMISSION ELECTRON SOURCE ARRAYS

(75) Inventors: Hiroshi Ohki, Tokyo (JP); Masao Urayama, Saitama (JP)

(73) Assignee: Sharp Kabushiki Kaisha, Osaka (JP)

( * ) Notice: Subject to any disclaimer, the term of this patent is extended or adjusted under 35 U.S.C. 154(b) by 154 days.

(21) Appl. No.: 09/655,737

(22) Filed: Sep. 6, 2000

(30) Foreign Application Priority Data

Oct. 21, 1999 (JP) ..... 11-299250
Jul. 28, 2000 (JP) ..... 2000-228887

(51) Int. Cl.[7] ..... H01J 1/02; H01J 1/62; H01J 17/24

(52) U.S. Cl. ..... 313/309; 313/495; 313/553

(58) Field of Search ..... 313/309, 310, 313/336, 351, 422, 553, 495–497

(56) References Cited

U.S. PATENT DOCUMENTS 5,223,766 A * 6/1993 Nakayama et al. ..... 313/495
5,773,921 A * 6/1998 Keesmann et al. ..... 313/309
5,932,963 A * 8/1999 Nakamura et al. ..... 313/495
5,973,444 A * 10/1999 Xu et al. ..... 313/309
6,236,381 B1 * 5/2001 Kurata et al. ..... 313/422 X

FOREIGN PATENT DOCUMENTS

JP 10-50240 2/1998
JP 11-162383 6/1999

* cited by examiner

*Primary Examiner*—William J. Royer
(74) *Attorney, Agent, or Firm*—David G. Conlin; William J. Daley, Jr.; Edwards & Angell, LLP

(57) ABSTRACT

Featured is an image forming device for driving field emission electron sources capable of low-vacuum operation, high in ion impact resistance, and controlled in orientation, under X-Y addressing through electrode lines of simple and low-cost configuration. The image forming device includes cathode electrode lines and gate electrode lines of wire structure, where the field emission electron sources are selectively grown on the cathode electrode lines. A vacuum gap is provided between a supporting substrate on the back-plate side and the cathode electrode lines, and a getter is arranged on the supporting substrate.

10 Claims, 11 Drawing Sheets

FIG. 11 (a) PRIOR ART
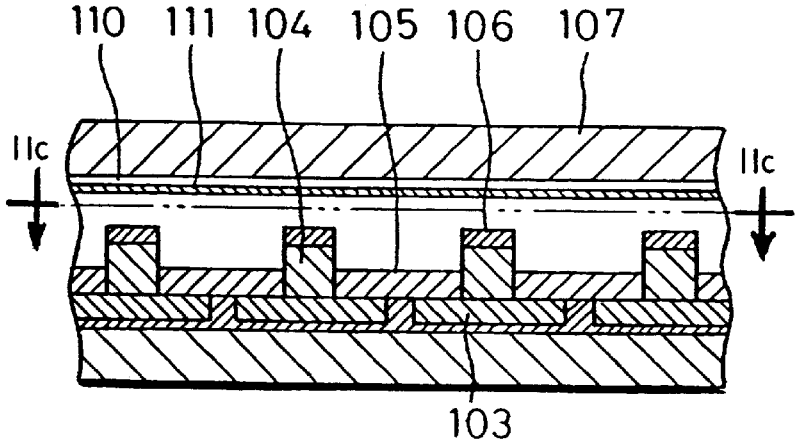
FIG. 11 (b) PRIOR ART
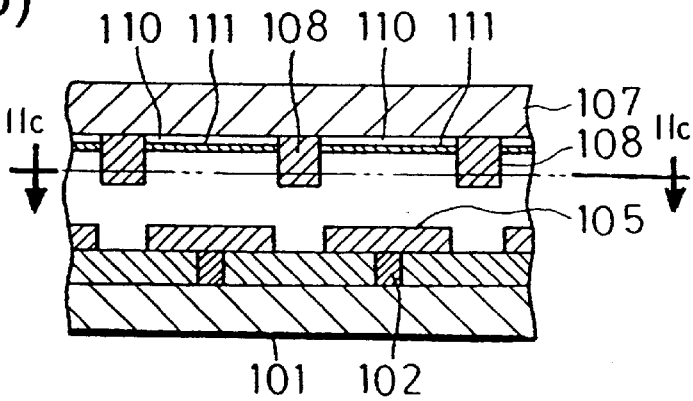
FIG. 11 (c) PRIOR ART
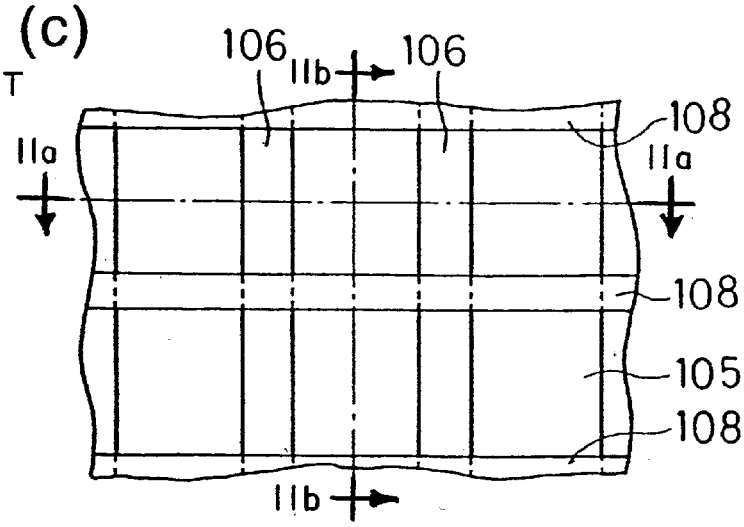

IMAGE FORMING DEVICE USING FIELD EMISSION ELECTRON SOURCE ARRAYS

BACKGROUND OF THE INVENTION

1. Field of the Invention

This invention relates to an image forming device which uses field emission electron sources for use in a cold cathode lamp, a fluorescent display tube, a backlight for a liquid crystal device, a field emission display, and the like. In particular, the invention relates to an image forming device provided with cathode electrodes, gate electrodes, and focusing electrodes of wire structure, as well as a getter of greater surface area.

2. Description of the Related Art

In recent years, much research and development has been made on field emission electron sources for releasing field emission electrons under a high electric field, with the expectation of their application to flat panel displays, i.e., field emission displays (FEDs).

Well-known among those field emission type electron sources are field emission sources of pyramidal shape, made of the metal material that is used for the conical electron sources formed of a high melting-point metal material through the evaporation method by C. A. Spindt et al. (U.S. Pat. No. 3,665,241)

Such pyramidal field emission electron sources are fabricated in a self-aligning fashion by making holes of the order of 1 $\mu$m and then using the evaporation method. Recently, 10-odd-inch FEDs using such pyramidal field emission electron sources have been announced to receive much attention.

Meanwhile, an image forming device using carbon nanotubes have been disclosed lately. A carbon nanotube, having a nested structure of cylindrically wound graphite layers, was found by Iijima et al. (S. Iijima, Nature, 354, 56, 1991)

As disclosed in Japanese Patent Laid-Open Publication No. Hei11-162383, such an FED using carbon nanotubes (see FIGS. 11(*a*) to 11(*c*)) has been constituted by forming electrode lines and insulators on a substrate.

On a substrate 101 there are formed an electrode wiring layer 102 and an insulating film 103 on which substrate-side ribs 104 are arranged at predetermined intervals. An electron emitter portion 105 is formed on the insulating film 103 between the substrate-side ribs 104 and an electron extracting electrode 106 is formed on the substrate-side ribs 104. A front-end glass substrate 107 and the substrate 101 are spaced from each other by the perpendicularly crossing substrate-side ribs 104 and a front-end rib 108 by a predetermined distance. A light-emitting portion 110 comprising a fluorescent material is formed in a region sandwiched by the front-end ribs 108 on the inner surface of the front-end glass substrate 107, where the a metal back film coats surface of the light-emitting portion.

Moreover, as described in Japanese Patent Laid-Open Publication No.Hei 10-50240, a conventional FED has had a getter arranged in the vicinities of luminant layers on its face plate so as to provide uniform gas absorption for the entire interior of the envelope.

Nevertheless, the FEDs using such field emission electron sources of pyramidal shape, made of the conventional metal material have had the problem that micromachining of the order of 1 $\mu$m is required and the individual field emission electron sources cannot be controlled uniform in shape.

In addition, the operating vacuum level as high as $10^{-9}$ Torr and breakage of the field emission electron sources due to the ion sputtering by residual gas have been another problem.

Meanwhile, the FED using conventional field emission electron sources made of carbon nanotubes has had the problem of how to subdivide the carbon nanotube electron sources for micropixels and to control the orientation of the carbon nanotubes.

Furthermore, the pyramidal, the carbon-nanotubed, and other conventional FEDs have had the problem that the number of steps for forming and patterning thin layers is increased by the formation of a cathode, gate insulator, gate electrode, interlayer insulation film, focusing electrode, and the like. These FEDs have also had the problem that the getters for maintaining the FED operating vacuum level can only be arranged to the envelope rims, precluding efficient evacuation.

Moreover, the conventional FED having the getter arranged in the vicinities of the luminant layers on its face plate has had the problem that an increase in getter surface area for the sake of enhancing absorption efficiency brings about a drop in intensity.

SUMMARY OF THE INVENTION

The present invention has been achieved in view of the foregoing problems, and an object thereof is to provide an image forming device for driving field emission electron sources capable of low-vacuum operation, high in ion impact resistance, and controlled in orientation, under X-Y addressing through electrode lines of simple and low-cost configuration. Another object of the present invention is to provide an image forming device in which a getter capable of efficient degassing is arranged to cope with greater areas.

To solve the foregoing problems, the present invention in a first aspect provides an image forming device comprising: a first electrode line formed on a supporting substrate; an electron source array formed on the first electrode line; a second electrode line arranged to be orthogonal to the first electrode line; and an insulator for providing electric insulation between the first electrode line and the second electrode line. Here, at least either one of the first electrode line and the second electrode line has a wire structure, and the insulator is a first vacuum gap. This simplifies the structure and the fabrication steps of the image forming device.

In a second aspect, the present invention provides an image forming device in which: the second electrode line has the wire structure; the second electrode line is composed of a plurality of electrode lines each having the wire structure; and a pixel includes a plurality of electron source arrays mentioned above. This simplifies the gate electrode structure in an X-Y addressable image forming device, and omits the gate insulator.

In a third aspect of the present invention, the first electrode line is provided with a region onto which the electron source array is selectively formed. Thereby, the electron source array is selectively integrated onto a desired pixel area in the image forming device.

In a fourth aspect of the present invention, the aforesaid region contains a metal catalyst selected from the group consisting of cobalt, nickel, iron, and an alloy of the metal catalyst, while the electron source array contains one selected from the group consisting of diamond, diamondlike carbon, and carbon nanotubes. This makes the image forming device high in ion impact resistance and capable of low-vacuum operation, as well as enhances the electron source array in orientation controllability.

In a fifth aspect, the present invention provides an image forming device in which the aforesaid region has a multilayer structure of a metal anodic oxide film, an anodic oxidation stop layer, and the metal catalyst. This means enhanced adhesion of the electron source array, reduced dust production in the fabrication processes, and improved reliability of the image forming device.

In a sixth aspect, the present invention provides an image forming device having the metal anodic oxide film made of aluminum, so as to control the packaging density in the electron source array of the image forming device and the sizes of the individual electron sources.

In a seventh aspect, the present invention provides an image forming device in which both the first electrode line and the second electrode line have a wire structure. This simplifies the structure and the fabrication steps of an X-Y addressable image forming device.

In an eighth aspect of the present invention, the supporting substrate and the first electrode line are isolated from each other by a second vacuum gap. Thereby, it becomes possible to arrange a getter on the supporting substrate, maintaining the image forming device in a high vacuum and increasing its panel area.

In a ninth aspect of the present invention, the getter is made of a carbon material selected from the group consisting of graphite, carbon nanotubes, and fullerenes. This enhances the gas absorption efficiency inside the image forming device and improves reliability.

In a tenth aspect of the present invention, a third electrode line is arranged over the second electrode line, and the third electrode line is formed in a wire structure. This avoids crosstalk in an image forming device and simplifies the structure and the fabrication steps of an image forming device with focusing electrodes.

The above and other objects, effects, features and advantages of the present invention will become more apparent from the following description of embodiments thereof taken in conjunction with the accompanying drawings.

BRIEF DESCRIPTION OF THE DRAWINGS

In the accompanying drawings:

FIGS. 11(*a*) to 11(*c*) are structural diagrams showing a conventional FED using carbon nanotubes, where FIGS. 11(*a*) and 11(*b*) are cross-sectional views taken along lines 11*a*—11*a* and 11*b*—11*b* respectively of FIG. 11(*c*) and FIG. 11(*c*) is a plan view looking down from the 11*c*—11*c* plane of FIGS. 11(*a*)) and 11(*b*).

DETAILED DESCRIPTION OF THE PREFERRED EMBODIMENTS

Hereinafter, preferred embodiment of the present invention will be described in detail with reference to the accompanying drawings.

First Embodiment

Figure 1:
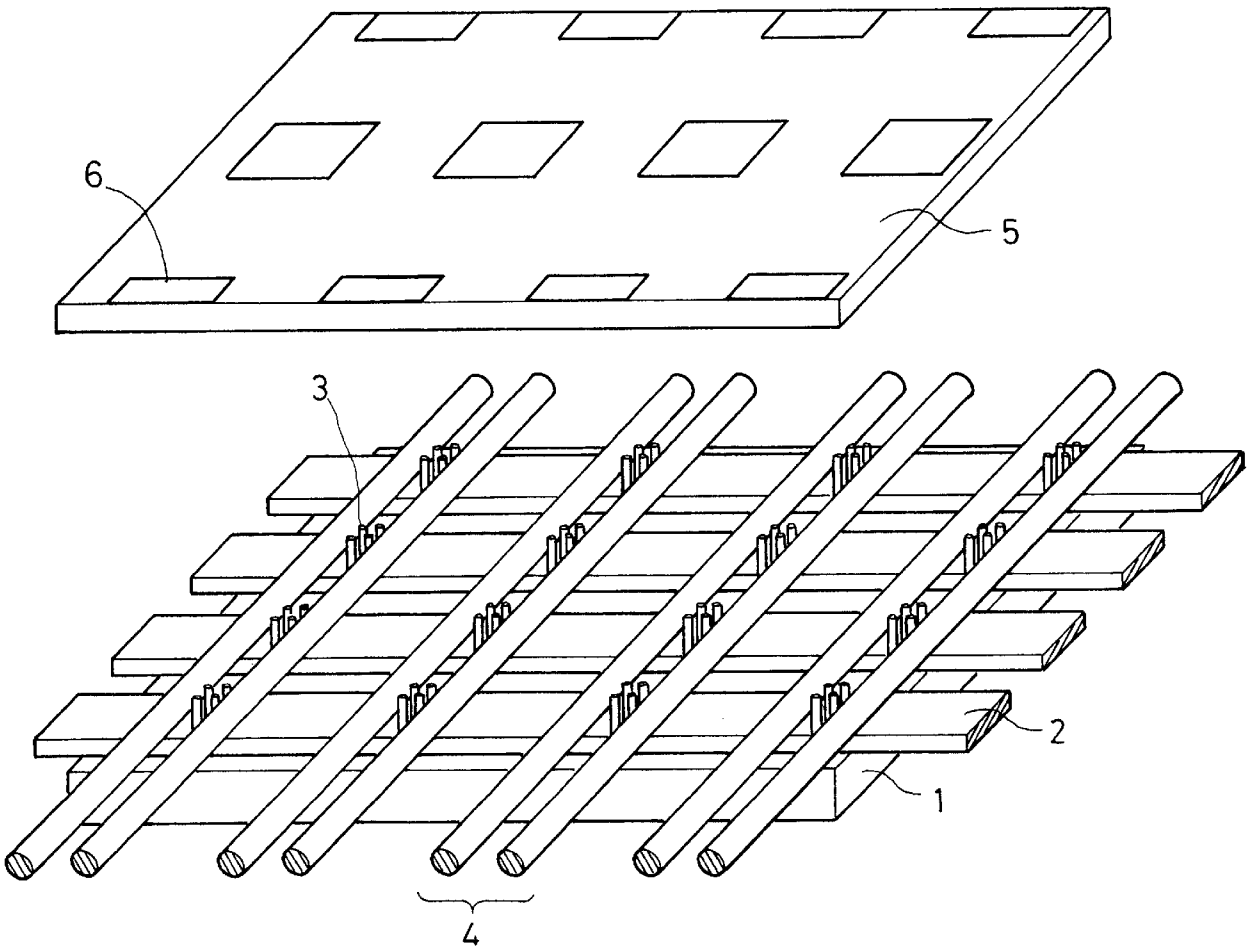
FIG. 1 is a perspective view of an image forming device using wire-structured electrode lines according to a first embodiment of the present invention.

FIG. 1 is a perspective view showing the configuration of an image forming device according to a first embodiment of the present invention.

In FIG. 1, a back plate of the image forming device comprises a supporting substrate 1, cathode electrode lines 2, field emission electron source arrays 3, and gate electrode lines 4.

The field emission electron source arrays 3 electrically connected to the cathode electrode lines 2 emit cold electrons under a voltage applied to the gate electrode lines.

The electrons emitted into a vacuum are accelerated by a voltage applied to an anode electrode 5 and collide with luminants 6, causing light emission and forming an image.

Figure 2:
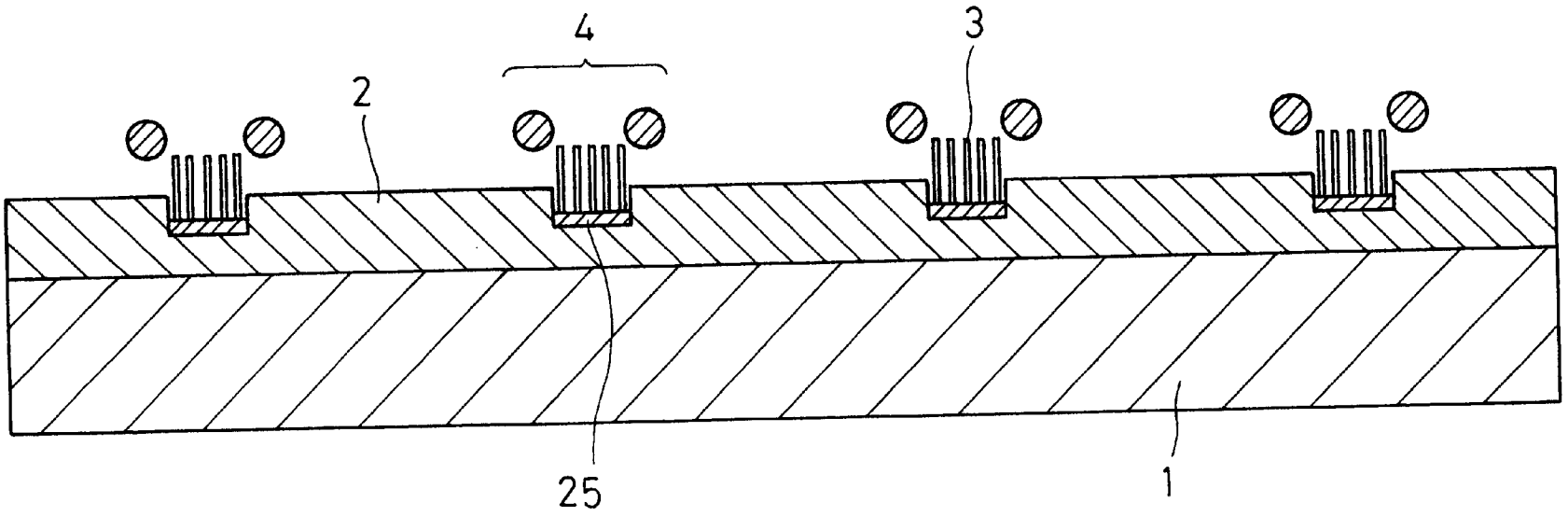
FIG. 2 is a sectional view of the image forming device using the wire-structured electrode lines of the present embodiment.

The back plate is further detailed in FIG. 2. FIG. 2 shows a sectional view of the image forming device according to the present invention.

The field emission electron source arrays 3 are selectively arranged into those recessed regions formed in the cathode electrode lines 2.

These regions must be provided in advance with a material for selectively arranging the field emission electron source arrays 3. In the present embodiment, thin films of iron alloy are formed in the recessed regions of the cathode electrode lines 2, and then carbon nanotubes are formed by plasma-assisted CVD (chemical-vapor deposition) to constitute the field emission electron source arrays 3. The thin films formed in the recessed regions of the cathode electrode lines 2 preferably are composed of either a metal catalyst such as cobalt, nickel, and iron, or an alloy of the metal catalyst.

It is also preferable that the catalyst is appropriately selected so that the field emission electron source arrays 3 are made of diamond, diamondlike carbon, or graphite.

The formation of carbon nanotubes by CVD sometimes-requires heating of the order of 800–1000° C.

This heating can damage the supporting substrate 1 and the like under the cathode electrode lines 2. Therefore, when the forming temperature is 500–1000° C. or so, a ceramic substrate made of alumina or an alumina-silica mixture is preferably used as the supporting substrate 1.

Moreover, the gate electrode lines 4 are composed of a metal material worked into the form of a wire, and are arranged near the field emission electron source arrays 3 so as to cross the cathode electrode lines 2 at right angles.

Constituting the gate electrode lines 4 in the wire form as described above eliminates the need for the deposition and patterning of gate electrode lines, 4 and a gate insulator. This makes it possible to simplify both the structure of the image forming device and the fabrication steps thereof.

When the pixels the field emission electron source arrays 3 are arranged for are large in area, each of the pixels is preferably divided into several portions so that field emission electron source arrays 3 are assigned for the respective portions to make the field distribution on the surface of each pixel uniform.

Figure 3:
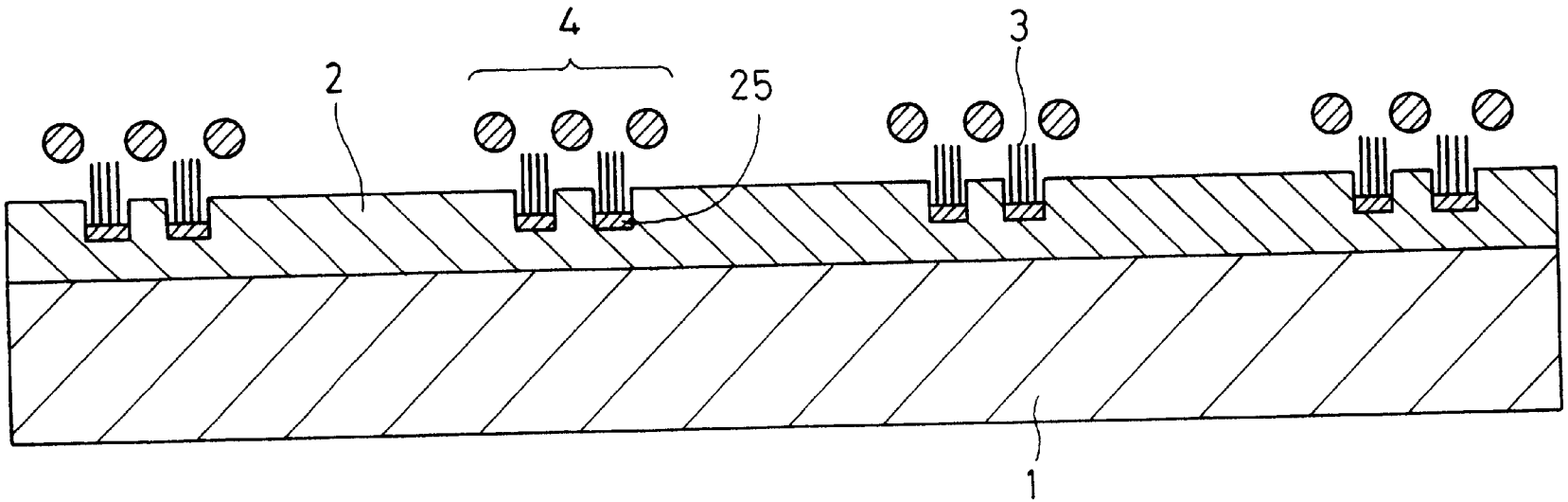
FIG. 3 is a sectional view of an image forming device with divided field emission electron sources of the present embodiment.

More specifically, as shown in FIG. 3, a plurality of recessed regions are formed in each pixel part of the cathode electrode lines 2. In each of the recessed regions, a thin film 25 made of a metal catalyst such as iron, cobalt, and nickel is formed and then a field emission electron source array 3 is formed.

A gate electrode line 4 of wire form is arranged between every adjacent recessed region to constitute data lines (or scan lines) composed of at least three wire-formed gate electrode lines 4.

The field emission electron source arrays 3 formed in the pixel parts as described above are weak in adhesion and can possibly peel off during the fabrication process or in operation, producing dust to deteriorate the image forming device.

Figure 4:
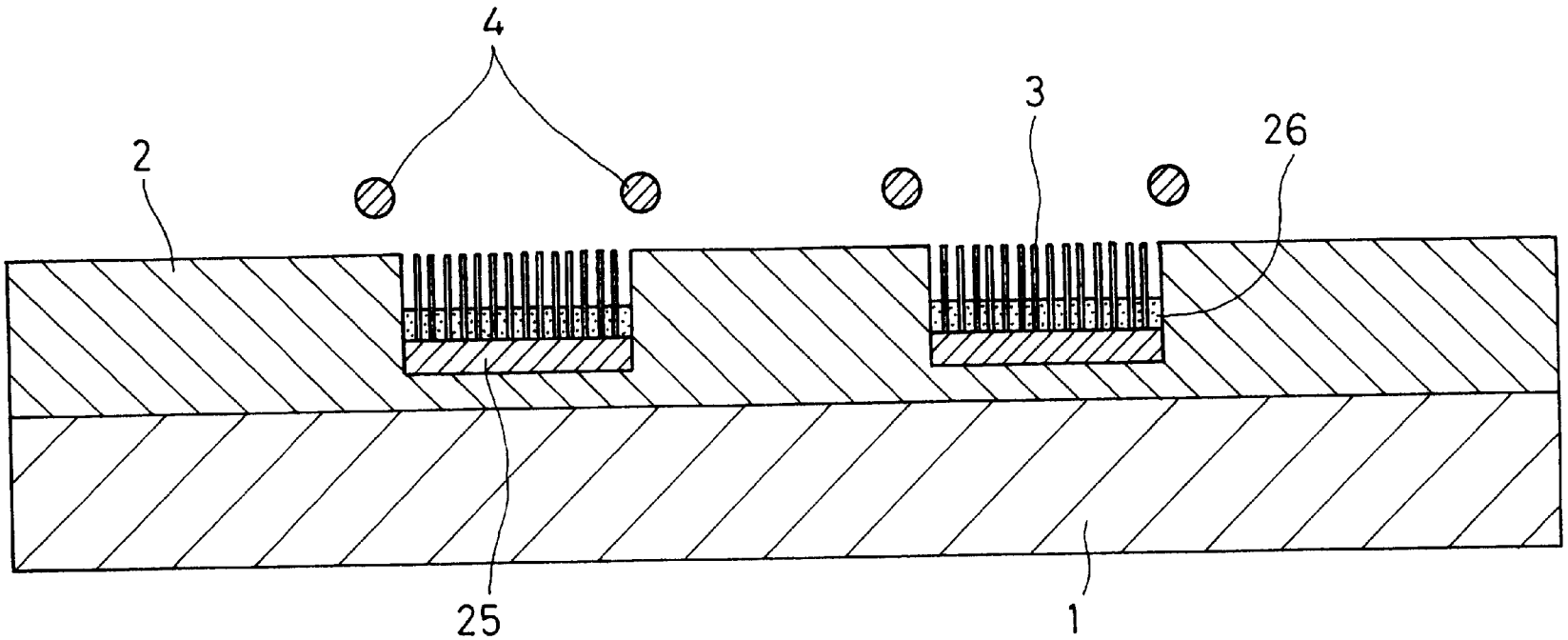
FIG. 4 is a sectional view of an image forming device using dust-free field emission electron sources of the present embodiment.

In view of this, it is preferable to adopt the structure as shown in FIG. 4, of using metal anodic oxide films 26 as support layers of the field emission electron source arrays 3.

That is, the metal catalyst thin films 25 and anodic oxidation stop layers are formed in the recessed regions of the cathode electrode lines 2, followed by the metal anodic oxide films 26.

The metal anodic oxide films 26 essentially require that fine pores be formed therein. In the present embodiment, aluminum is used for the metal anodic oxide films 26. Tantalum and the like may be used aside from aluminum, whereas aluminum is best preferable in view of diameter and density controls to the fine pores.

The field emission electron source arrays 3 are grown with the metal catalyst beneath the fine pores of the meal anodic oxide films 26 as the growing points.

The metal catalyst can be easily exposed by either removing the anodic oxidation stop layers from the pore bottoms or filling the metal catalyst into the pores of the metal anodic oxide films 26.

According to the present embodiment, aluminum was anodized to produce metal anodic oxide films 26 having pores of the order of 30 nm in diameter and 100 nm in pitch.

Subsequently, hydrocarbon gas was introduced into the plasma, so that carbon nanotubes were grown as shown in FIG. 4 with the metal catalyst thin films 25 made of an iron alloy under the metal anodic oxide films 26 as the growing points.

The carbon nanotubes grown thus were selectively developed on the iron alloy thin films 25 exposed at the pore bottoms, and firmly held by the aluminum anodic oxide films 26.

The image forming device formed thus was driven for basic operation checks in the following manner.

Figure 5:
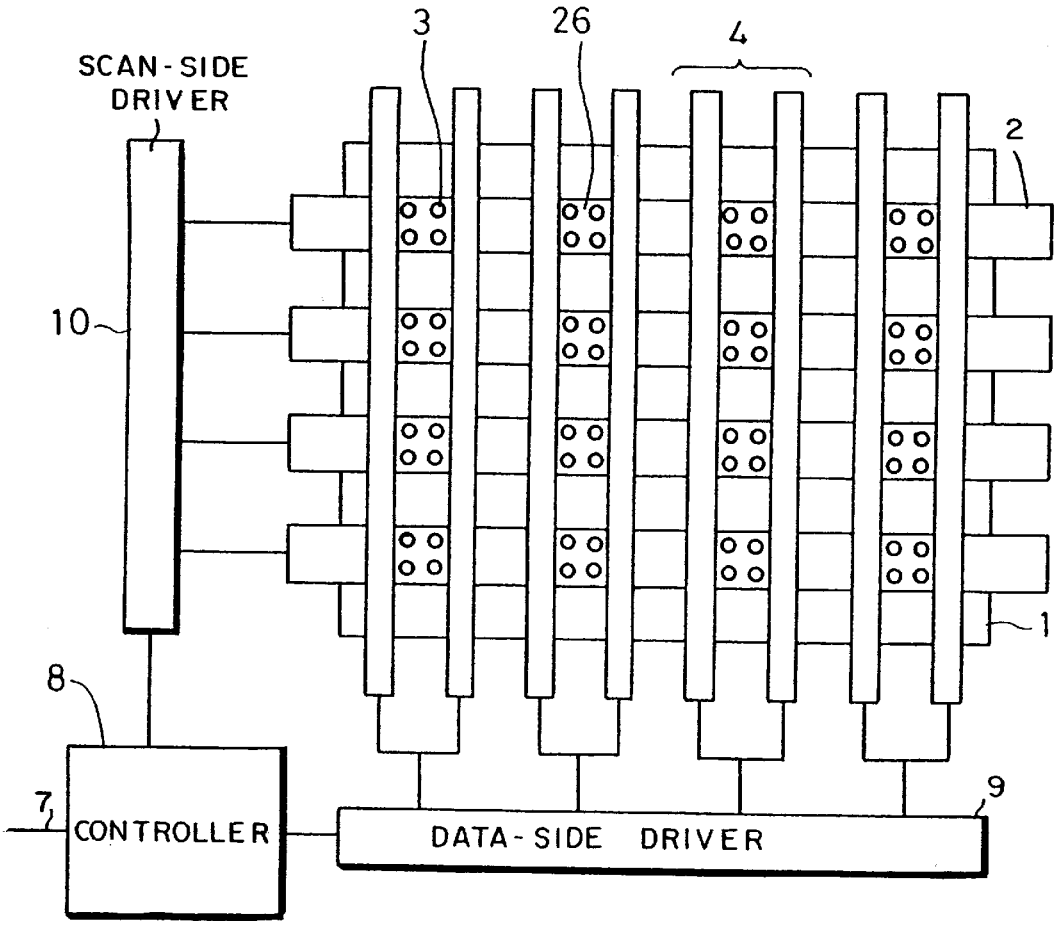
FIG. 5 is a plan view of an image forming device, including the driving system of the present embodiment.

FIG. 5 is a diagram showing the configuration of the driving system of the image forming device.

In FIG. 5, the numeral 7 represents a video signal for forming an image, 8 a controller, 9 a data-side driver to be controlled by the controller 8, and 10 a scan-side driver to be controlled by the controller 8.

Initially, a video signal 7 for forming an image is input to the controller 8.

The controller 8 controls the scan-side driver 10 to make a scan, so that the scan-side driver 10 applies a scan voltage to the cathode electrode lines 2 in succession.

Meanwhile, the data-side driver 9 controlled by the controller 8 applies voltages corresponding to the image data by horizontal line to the gate electrode lines 4.

In this way, those field emission electron source arrays 3 addressed by the cathode electrode lines 2 and the gate electrode lines 4 emit electrons into a vacuum.

The field emission was observed under a field intensity of the order of 1 V/$\mu$m, with a current density of 10 mA/cm$^2$.

Besides, the luminants opposed to the back plate having such field emission. electron source arrays 3 were measured and found to have an emission luminance of the order of 200–400 cd/m$^2$.

Second Embodiment

Figure 6:
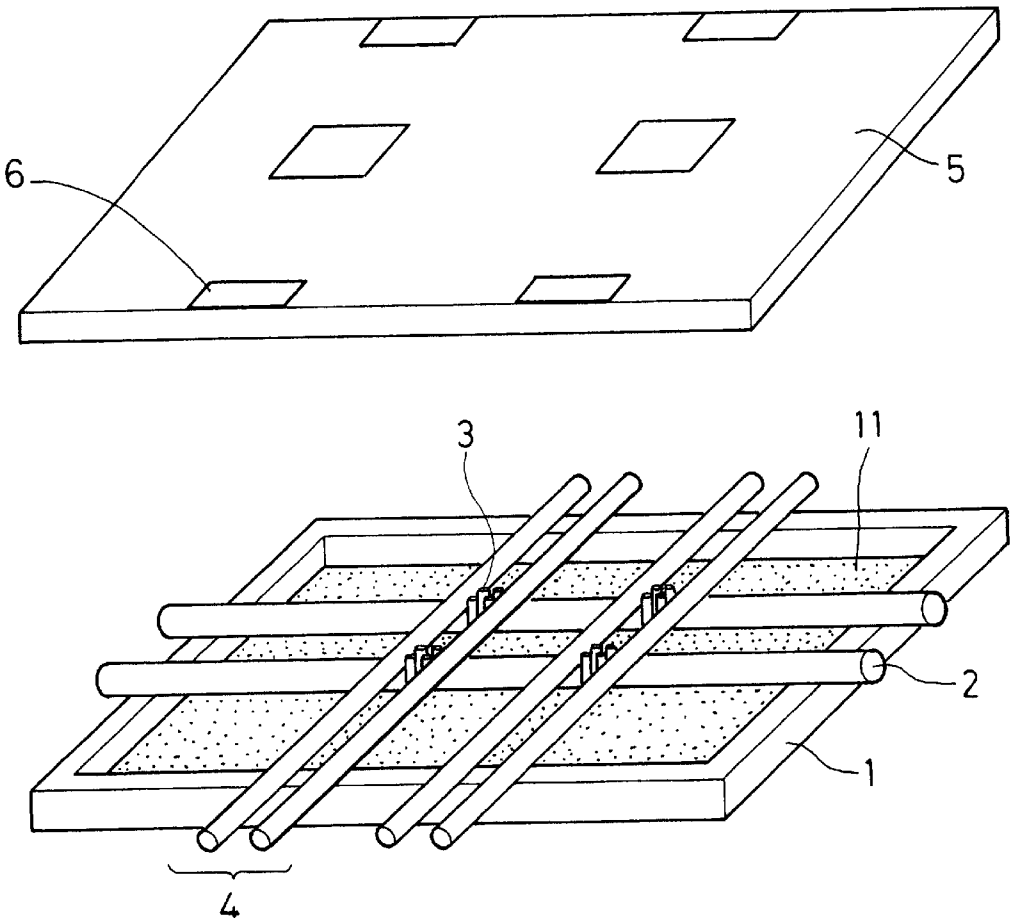
FIG. 6 is a perspective view of an image forming device using wire-structured electrode lines, provided with a getter according to a second embodiment of the present invention.

FIG. 6 is a perspective view showing an image forming device having both its cathode electrode lines 2 and its gate electrode lines 4 configured in a wire form.

This configuration of the image forming device in the present embodiment makes it possible to create a gap between the cathode electrode lines 2 and a supporting substrate 1 throughout the display area.

In such a gap is arranged a getter 11. A non-evacuation type getter is preferably arranged as the getter 11.

The non-evacuation getter may be a zircon-aluminum alloy or a zircon-vanadium-iron alloy in general use. The present embodiment, however, uses a carbon material such as graphite, carbon nanotubes, and fullerenes, so as to enhance the residual gas absorption property as well as to improve the ion impact resistance of the getter 11 against ions produced by the residual gas.

Figure 7:
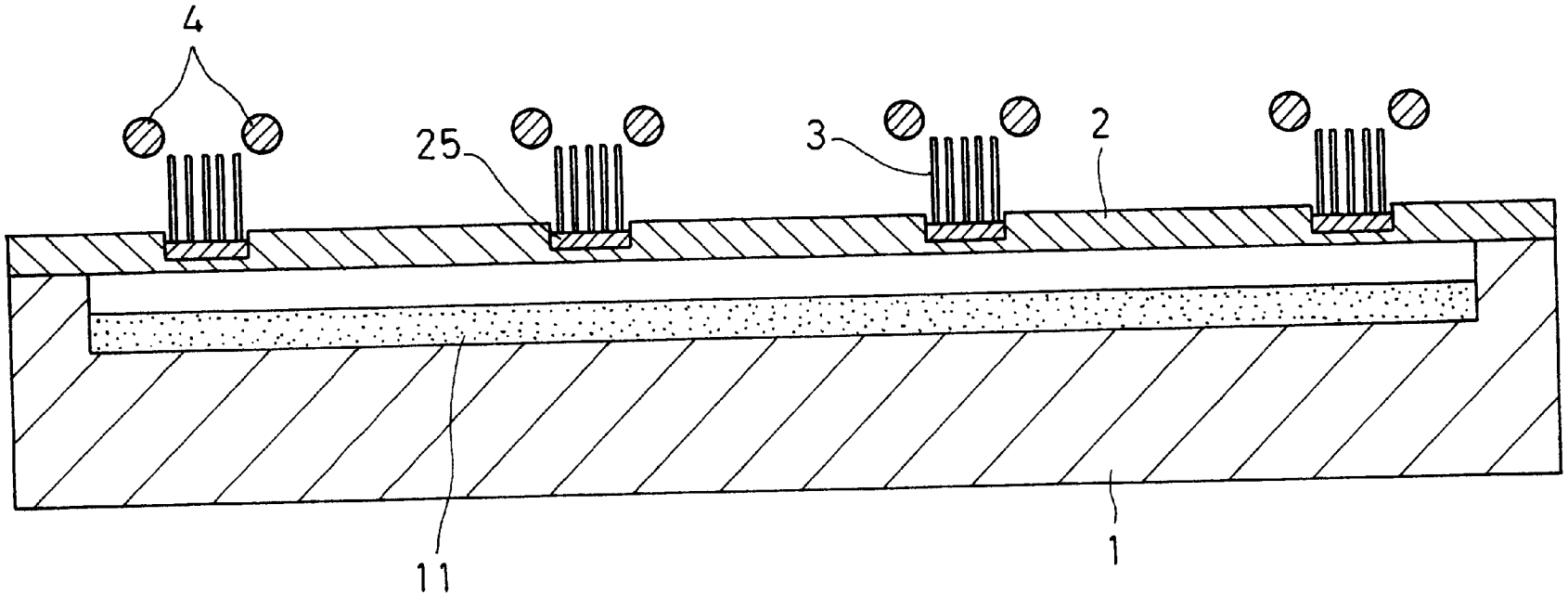
FIG. 7 is a sectional view of the image forming device using the wire-structured electrode lines, provided with the getter of the present embodiment.

FIG. 7 is a sectional view showing an image forming device according to the present embodiment;. As shown in FIG. 7, the getter 11 is arranged on the supporting substrate 1 on the back-plate side of the image forming device. This prevents the getter 11 from being limited to the periphery of the envelope in arrangement as in the conventional image forming devices, thereby allowing the provision of an image forming device having approximately the same size as that of the display area. Besides, it becomes possible for even a large-screen image forming device to maintain the vacuum level of the entire display area efficiently.

Third Embodiment

Figure 8:
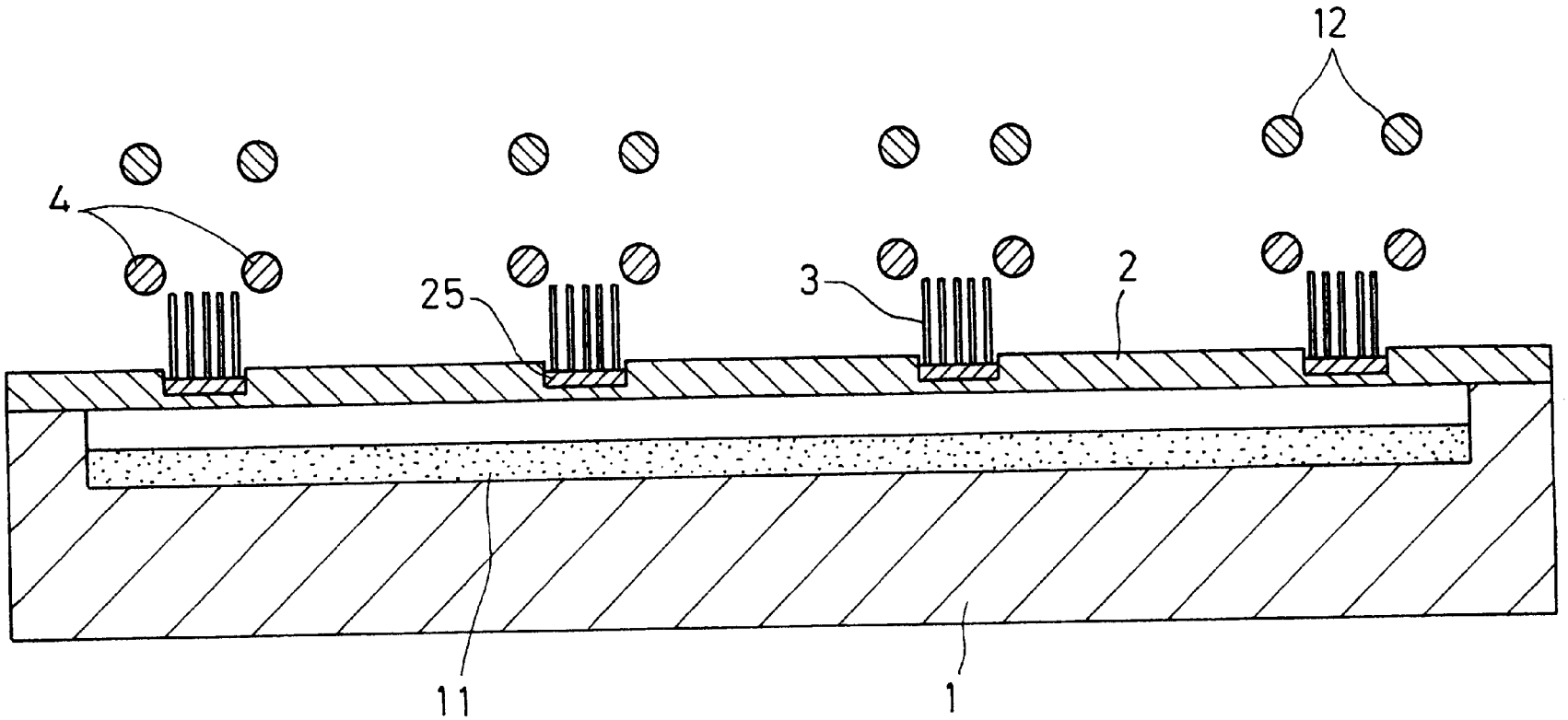
FIG. 8 is a sectional view of an image forming device provided with focusing electrodes according to a third embodiment of the present invention.

FIG. 8 is a sectional view showing an image forming device which includes focusing electrodes 12 arranged over its gate electrode lines 4.

The image forming device of the present embodiment is to provide a configuration to suppress display crosstalk. That is, cathode electrode lines 2 and the gate electrode lines 4 X-Y address field emission electron source arrays 3 to emit electron beams, and the electron beams emitted are focused by the focusing electrodes 12 so that the beams come into precise collisions with luminants 6 attached over an anode electrode 5 on the face-plate side.

In a conventional image forming device, such focusing electrodes 12 are arranged on an interlayer insulation film that is formed on the gate electrode lines 4. In the present embodiment, not only the gate insulator between the cathode electrode lines 2 and the gate electrode lines 4 is needless, but also the interlayer insulator between the gate electrode lines 4 and the focusing electrode 12 is unnecessary. The gate electrode lines 4 and the focusing electrodes 12 are electrically insulated from each other by means of a vacuum gap.

Fourth Embodiment

The present embodiment will describe a method of forming field emission electron sources easily and at low costs.

Figure 9:
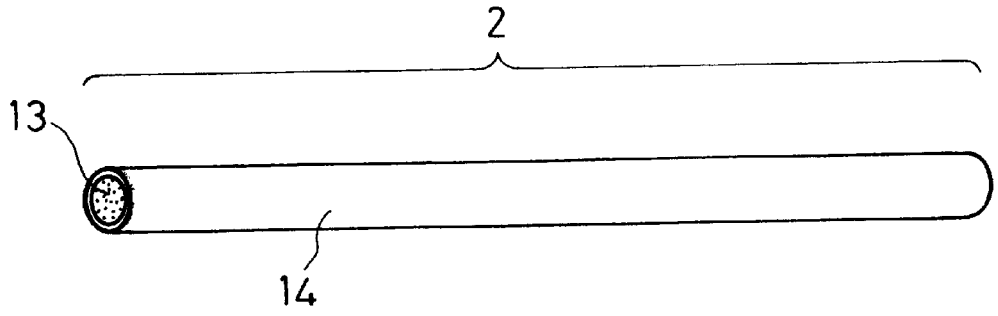
FIGS. 9(*a*) to 9(*c*) are process diagrams showing a fabrication method for forming a field emission electron source array selectively onto a cathode electrode line of wire structure according to a fourth embodiment of the present invention.
Figure 9:
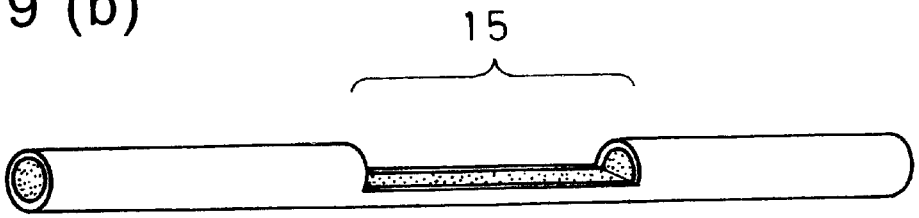
Figure 9:
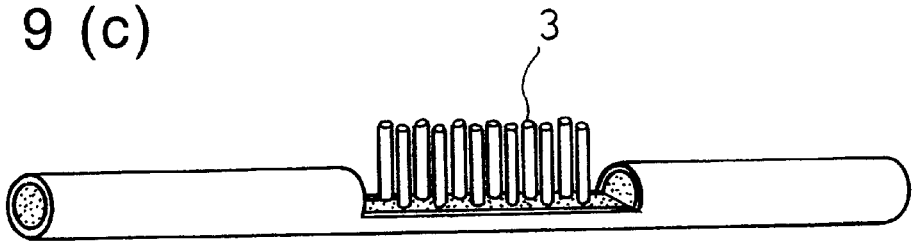

FIGS. 9(*a*) to 9(*c*) are process diagrams showing the fabrication method for forming a field emission electron source array 3 selectively onto, a pixel part of a wire-shaped cathode electrode line 2.

FIG. 9(*a*) shows the constitution of the cathode electrode line 2. The central region of the wire contains a metal catalyst material 13 such as nickel, cobalt, and iron. The surface of the metal catalyst material 13 is coated with a cathode line material 14 by electroplating or electroless plating.

For example, the application of electroplating allows a chromium coating on nickel, obtaining a cathode electrode line 2 containing nickel at the center and chromium on the surface.

The application of electroless plating allows a copper coating on iron, obtaining a cathode electrode line 2 with iron at the center and copper on the surface.

The constitution of the cathode electrode line 2 is not limited thereto, and may be appropriately selected by those skilled in the art.

FIG. 9(*b*) shows an example where a recessed region 15 is formed in the cathode electrode line 2. The mechanical grinding is made in accordance with the pixel size.

At the surface of the recessed region 15 is exposed the metal catalyst material 13. The remaining peripheral surface of the cathode electrode line 2 is left intact as the cathode line material 14.

FIG. 9(*c*) shows an example where a field emission electron source array 3 is selectively grown on the recessed region 15 at which the metal catalyst material 13 of the cathode electrode line 2 is exposed.

The field emission electron source array 3 described in the present embodiment is composed of carbon nanotubes. The use of CVD allows carbon nanotubes to be selectively grown on a metal catalyst material such as nickel, cobalt, and iron.

Carbon nanotubes can be formed by introducing hydrocarbon gas such as propylene and acetylene into a reactor heated up to 1000 ° C. or so. Aside from the heating, carbon nanotubes can also be formed under plasma assist.

Moreover, as described in the first embodiment, an anodic oxide film may be formed on the metal catalyst material 13 to improve the adhesion of the field emission electron source array 3.

Since the field emission electron source array 3 is thus formed on the cathode electrode line 2, it becomes possible to make a simplification and cost reduction of the structure and fabrication method of the image forming device.

Fifth Embodiment

The present embodiment will describe the configuration of an image forming device having its second electrode lines fixed with electrode supporting ribs.

The fixing by the electrode supporting ribs is constitutionally advantageous for image forming devices of larger screens. The electrode supporting ribs provide a constant distance between the electron sources and the second electrode lines to improve the emission current uniformity within the panel face.

Figure 10:
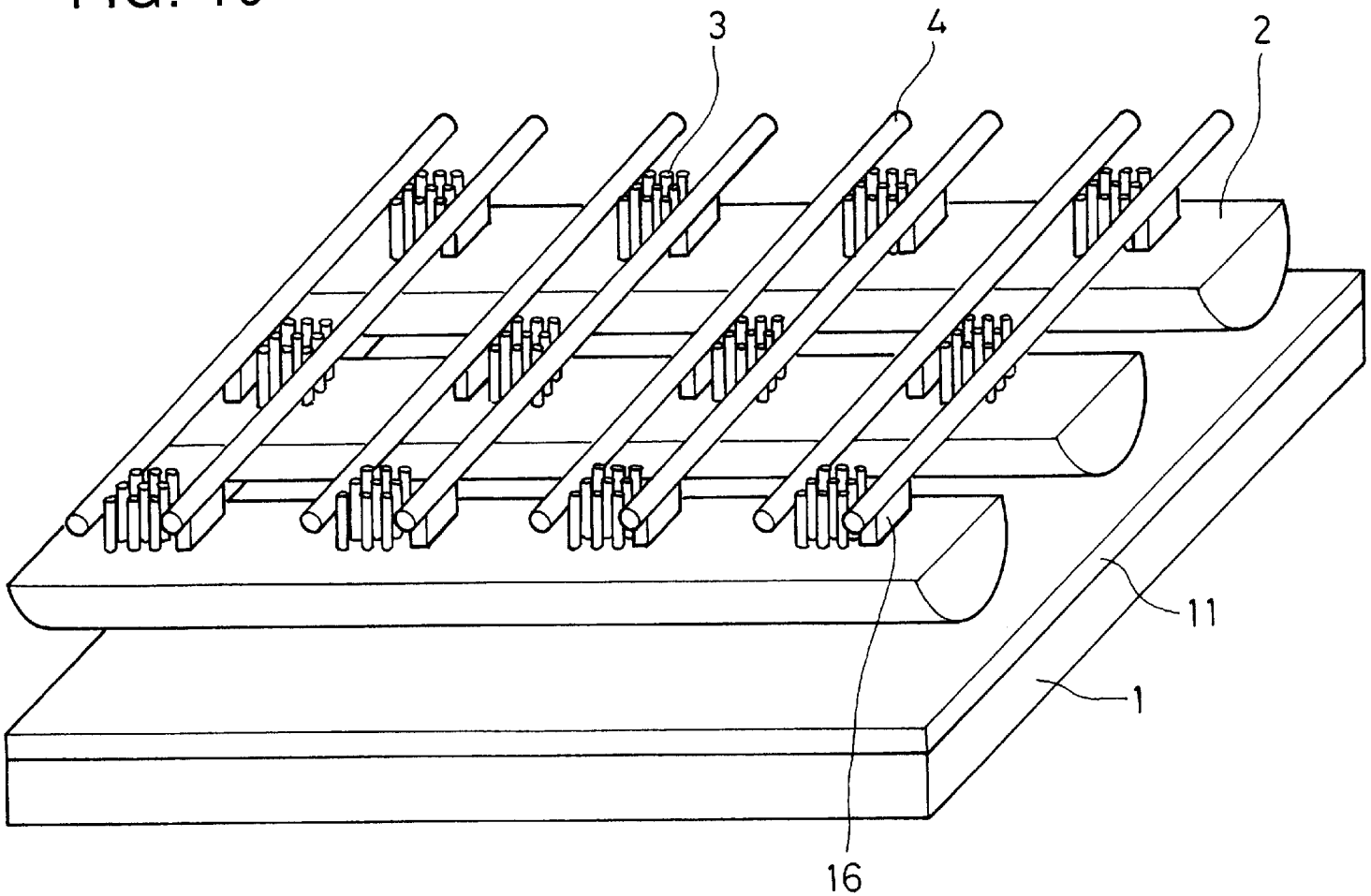
FIG. 10 is a perspective view of an image forming device using electrode supporting ribs according to a fifth embodiment of the present invention.

FIG. 10 is a perspective view showing the configuration of an image forming device using electrode supporting ribs of the present embodiment.

As shown in FIG. 10, the electrode supporting ribs 16, arranged near the intersections of cathode electrode lines 2 and gate electrode lines 4, keep the relative. positions of field emission electron source arrays 3 to the gate electrode lines 4 constant so that electric fields of uniform intensity are applied to the extremities of the field emission electron source arrays 3.

Since the field intensities at the extremities of the field emission electron source arrays 3 are thus uniformized, the respective emission currents in the pixels of the image forming device can be made constant to improve the uniformity in the emission intensities of the ruminants 6.

As has been detailed above, the cathode electrode lines 2 or the gate electrode lines 4 are formed in a wire structure. This allows the realization of an image forming device that is simplified in structure, easy to fabricate, and capable of X-Y matrix driving.

Further, the field emission electron source arrays 3 in the respective pixels are subdivided, and the gate electrode lines 4 formed by arranging a plurality of wire-structured gate electrode lines 4 are provided. This makes it possible to realize an image forming device with uniformized field intensities to the field emission electron source arrays 3 in the respective pixels.

Further, it is possible to realize an image forming device capable of arranging field emission electron source arrays 3 onto any regions of the cathode electrode lines 2.

Further, cobalt, nickel, iron, or an alloy thereof is arranged to the regions of the cathode electrode lines 2, and the field emission electron source arrays 3 are formed thereon with diamond, diamondlike carbon, graphite, or carbon nanotubes. This allows the realization of an image forming device that uses field emission electron source arrays 3 capable of low-vacuum operation and excellent in ion impact resistance.

Moreover, those field emission electron source arrays 3 in use are oriented perpendicular to the luminants 6 on the opposed anode electrode 5 with high integration, thereby achieving low voltage and high current density.

Further, the orientation-controlled, highly-integrated field emission electron source arrays 3 are firmly fixed by the metal anodic oxide films 26, whereby an image forming device having a dust-free structure can be realized.

Further, the metal anodic oxide films 26 are composed of aluminum anodic oxide films. This allows the realization of an image forming device that has a dust-free structure with high-precision controls to the diameter and density of the pores in the metal anodic oxide films 26.

Further, both the cathode electrode lines 2 and the gate electrode lines 4 are formed in a wire structure. Therefore, it becomes possible to constitute field emission electron source arrays 3 independent of the supporting substrate 1 on the back-plate side. This eliminates the process damage-related limitations on the supporting substrate 1, and allows the realization of an image forming device that is further simplified in structure, easy to fabricate, and capable of X–Y matrix driving.

Further, the getter 11 is arranged in the vacuum gap between the support substrate 1 on the back-plate side and the cathode electrode lines 2 of wire structure. Therefore, it is possible to realize an image forming device that is improved in residual gas absorption efficiency to allow stabilization of field emission currents and is provided with a vacuum evacuation structure coping with greater panel sizes.

Further, the getter 11 arranged in the vacuum gap between the supporting substrate 1 on the back-plate side and the cathode electrode lines 2 of wire structure is made of a carbon material such as graphite, carbon nanotubes, and fullerenes. This allows the realization of an image forming device that is further improved in residual gas absorption efficiency and provided with a getter 11 excellent in ion impact resistance.

Further, the provision of the wire-structured focusing electrodes 12 over the gate electrode lines 4 makes it possible to realize a crosstalk-preventive image forming device with a simple structure.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An image forming device comprising:

a first electrode line formed on a supporting substrate;

a field emission electron source array formed on said first electrode line;

a second electrode line arranged to be orthogonal to said first electrode line; and an insulator for providing electric insulation between said first electrode line and said second electrode line, wherein at least either one of said first electrode line and said second electrode line has a wire structure, and said insulator is a first vacuum gap.

2. The image forming device according to claim 1, wherein:

said second electrode line has said wire structure;

said second electrode line is composed of a plurality of electrode lines each having said wire structure; and said second electrode line is fixed by an electrode supporting rib.

3. The image forming device according to claim 1 or 2, wherein said first electrode line has a region onto which said field emission electron source array is selectively formed.

4. The image forming device according to claim 3, wherein:

said region contains a metal catalyst selected from the group consisting of cobalt, nickel, iron, and an alloy of said metal catalyst; and said field emission electron source array contains one selected from the group consisting of diamond, diamondlike carbon, graphite, and carbon nanotubes.

5. The image forming device according to claim 4, wherein said region has a multilayer structure of a metal anodic oxide film, an anodic oxidation stop layer, and said metal catalyst.

6. The image forming device according to claim 5, wherein said metal anodic oxide film is made of aluminum.

7. The image forming device according to claim 1 or 2, wherein both said first electrode line and said second electrode line have a wire structure.

8. The image forming device according to claim 1 or 2, wherein:

said supporting substrate is isolated from said first electrode line by a second vacuum gap; and a getter is arranged in said second vacuum gap on said supporting substrate.

9. The image forming device according to claim 8, wherein said getter is made of a carbon material selected from the group consisting of graphite, carbon nanotubes, and fullerenes.

10. The image forming device according to claim 1 or 2, wherein:

a third electrode line is arranged over said second electrode line; and said third electrode line has a wire structure.

* * * * *